United States Patent [19]

Pritchard

[11] Patent Number: 4,888,868

[45] Date of Patent: Dec. 26, 1989

[54] DISPOSABLE RAZOR ASSEMBLY WITH DETACHABLE PACKET CONTAINING SHAVING-ASSOCIATED MATERIAL

[76] Inventor: Kevin M. Pritchard, 15141 Becky La., Monte Sereno, Calif. 95030

[21] Appl. No.: 146,732

[22] Filed: Jan. 21, 1988

[51] Int. Cl.[4] ..... B26B 21/44

[52] U.S. Cl. ..... 30/41; 30/90; 132/289; 206/228; 206/234; 206/340; 206/349; 206/363; 206/568; 206/581

[58] Field of Search ..... 30/41, 47, 85, 90; 132/289; 206/228, 234, 340, 349, 363, 568, 581

[56] References Cited

U.S. PATENT DOCUMENTS

| | | | |
|---|---|---|---|
| 2,019,957 | 11/1935 | England | 30/41 |
| 2,589,327 | 3/1952 | Biggs | 132/289 X |
| 2,716,811 | 9/1955 | Case | 30/47 |
| 4,074,429 | 2/1978 | Roberts | 30/41 |

*Primary Examiner*—Frank T. Yost
*Assistant Examiner*—Michael D. Folkerts
*Attorney, Agent, or Firm*—Harold D. Messner

[57] ABSTRACT

In accordance with the present invention, a disposable razor assembly and method are provided in which a packet assembly is releasably secured to the handle of the disposable razor. The packet assembly includes a plastic packet having a side wall forming a reservoir for single-use shaving-associated material. The reservoir is automatically opened as the plastic packet is detached from the razor handle even in high humidity environments. Several embodiments are described.

11 Claims, 1 Drawing Sheet

DISPOSABLE RAZOR ASSEMBLY WITH DETACHABLE PACKET CONTAINING SHAVING-ASSOCIATED MATERIAL

FIELD

The present invention relates to shaving systems in general, and more particularly to manually operated disposable razors having in combination therewith means for carrying sufficient shaving gels and after shave lotion for single-use application. In accordance with the present invention, one or more plastic packets of shaving gel and/or after shave lotion are removably secured by integral tabs to the disposal razor handle. Using the handle as a stabilizing support, sufficient leverage can be generated even where the user's hands are wet to simultaneously release and rupture the plastic packet(s) containing the shaving-associated material (gel or lotion). The system is handy for travel as (i) only the correct amount of pre-measured gel/lotion accompanies the razor and unnecessary excess is kept to a minimum, and (ii) the three key parts of the system (razor, gel, and lotion) are combinable as a unit so that they cannot be overlooked during packing.

BACKGROUND

In conventional hand razors, a razor blade is mounted in the shaving head which is carried at the end of a handle normally grasped by the user's hand. Before shaving, the user conventionally applies shaving-associated materials such as lathers, creams, gels and the like, to the face or body portions to be shaved. Such materials are typically supplied in large, relatively heavy (from a traveller's point of view) multiple serving plastic and/or metallic containers. Since shaving is most often carried out in semi-closed rooms of high humidity (bathrooms and showers), such containers become slippery and difficult to manipulate when the user's hands become wet. Further, no one likes to carry excess weight on a trip. It makes little sense to carry a razor, shaving foam can, and after-shave lotion of weighing on the order of 22–30 ounces on an overnight or 2-day trip. The cans are bulky and difficult to store, especially where luggage space is limited. Cans and lotion bottles can leak in the luggage, especially at low pressure in airplane baggage compartments.

Many relatively successful attempts have been made to provide a handle or other means in the razor which incorporates a reservoir for a lather forming material or for a lotion. Examples of such patents include U.S. Pat. No. 4,129,942, (Denigman) having separate compartments for gels and lotions; U.S. Pat. No. 4,433,483 (Lazarus) incorporating an aerosol spray can in the handle; U.S. Pat. No. 4,562,643, (Cataudalla) showing a renewable housing for the shaving gel; U.S. Pat. No. 4,635,361 (Demars), showing a tube squeezer for shaving lotion; and U.S. Pat. No. 3,985,146 (Allbeck), for a handle formed of a flexible tube which itself constitutes the reservoir of the shaving cream.

These razors also suffer from several drawbacks. For example: some razors do not provide enough lather, the reservoir having been overly used in prior occasions; another requires the handle to be flexible in order to squeeze out the shaving material, resulting in difficulty and danger in use when the handle becomes too flexible; still others require the handle and the shaving head to be mechanically disengaged before the shave-associated materials can be used. Also, they are complex and can become easily damaged to the point of inoperativeness if dropped, a common occurrence when handled with wet, soapy hands. Accordingly, there is a need for a simple, cheap-to-manufacture, single-use, shaving system that is lightweight, disposable, non-bulky, and contains in a single package all that is needed for shaving.

THE INVENTION

Summary

In accordance with the present shaving system invention, an improved disposable razor assembly is provided having capabilities related to (a) caddying shaving-associated materials to a remote use site such as a room with high humidity (bathroom and shower), and (b) facilitating shaving operations at such remote site.

In accordance with apparatus aspects, the present invention comprises an improved disposable razor assembly that includes:

(a) a handle having a first portion attached to and carrying a shaving head thereon suitable for use as a manually operated razor and a second portion normally grasped by users during shaving operations, the second portion of the handle being provided with one or more broad surfaces, (b) one or more assemblies adapted to be removably secured piggy-back style to the surface(s) of the handle, and comprising a releasably connected plastic packet having a rupturable reservoir containing a single-use serving of shaving-associated material such as shaving gel, shaving cream, after shave lotion or the like, and being disposed so that substantially simultaneous release of the packet relative to said handle and rupture of said reservoir can be easily achieved irrespective of humidity at the use site.

Attachment of the packet assembly to the handle is preferably by heat wherein a base portion of a tab assembly is thermally welded to the handle. However, other techniques could be used to provide such attachment, as by way of adhesives. In any event, the shaving-associated material of interest is easily caddied to the use site by the razor without the usual difficulties associated with transport of such toiletries.

In accordance with method aspects of the present invention, a procedure is provided for causing substantially simultaneous release and rupture of a plastic packet containing the shaving-associated material of interest even in highly humid environments, comprising the steps of:

(a) applying twisting pressure to the packet along a twisting axis to release the packet from the handle while the razor assembly is stabilizingly maintained even in the presence of humid air at the use site, and (b) almost simultaneously with step (a), causing rupture of a small wall region of the packet, the twisting pressure preventing accidental discharge of the shaving-associated material as the packet is released from the razor handle and ruptured.

In steps (a) and (b), above, the twisting pressure is applied to the packet only after the user's hand has been placed in non-slip contact with the razor assembly.

Then, using such handle as a stabilizing support sufficient leverage can be easily generated to simultaneously release and rupture the plastic packet.

In addition, the shaving-associated material will not be overly expelled from the packet since the severing and rupturing forces acting on the packet are more easily controlled, even if the use site is highly humid.

Other advantages and features of the present invention will become apparent from a reading of the following detailed description of preferred embodiments with reference to the following drawings.

Figure 1:
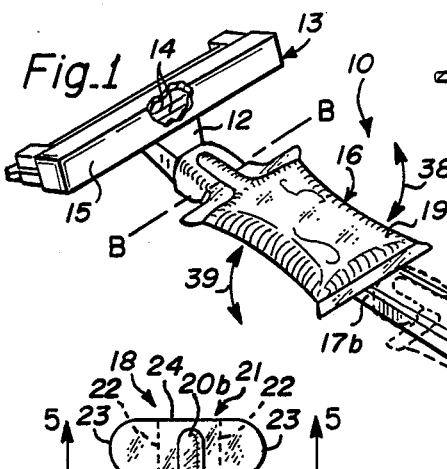
FIG. 1 is a perspective view of a razor assembly in accordance with the present invention in which a conventional disposable razor is provided with a packet assembly releasably secured to thereof, the packet assembly serving as a reservoir for shaving-associated materials.
Figure 2:
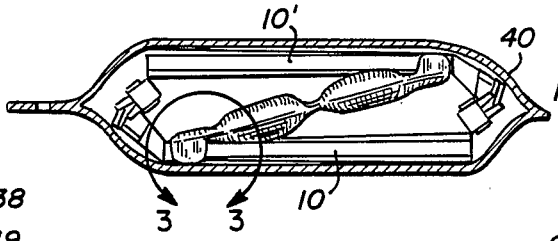
FIG. 2 is a side elevation view of the razor assembly of FIG. 1 in which two razor assemblies have been placed face-to-face within a container.
Figure 4:
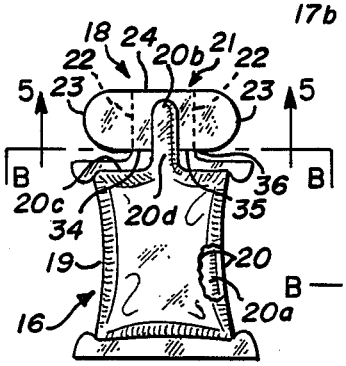
Figure 6:
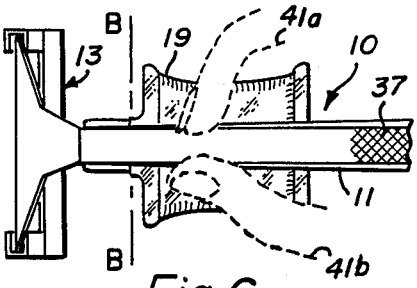
Figure 7:
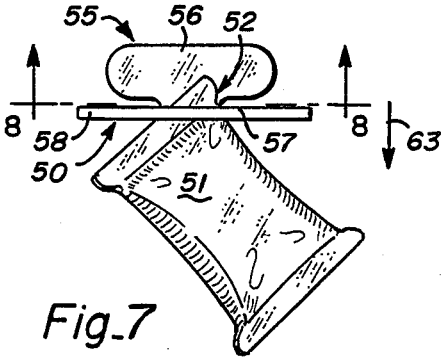
Figure 8:
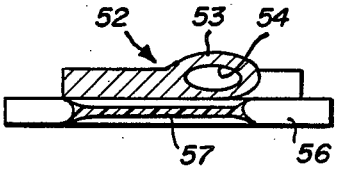
Figure 9:
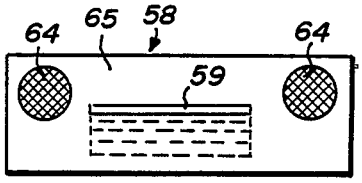
Figure 10:
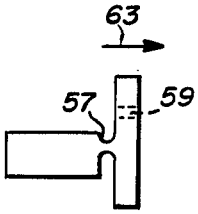
Figure 11:
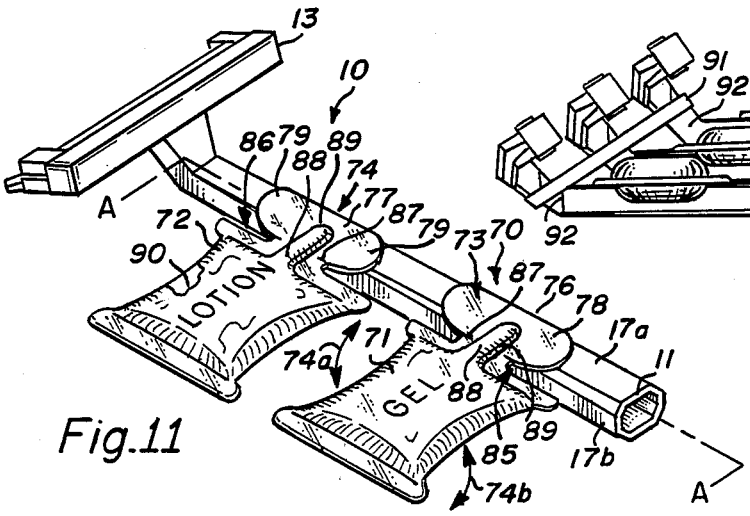
Figure 12:
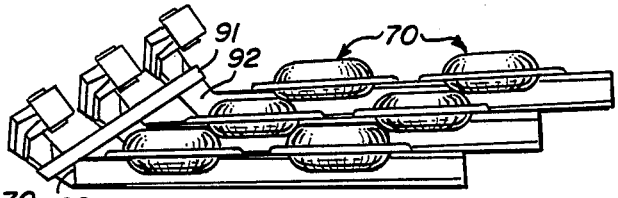

FIG. is a greatly enlarged detail of a tear-away tab assembly of the packet assembly of FIG. 2 illustrating how the shape of the tab assembly aids in the release of the packet(s) from the razor handle and in the rupturing of the packets along a swedged neck region of a protruding head;

FIG. 4 is a top view of the packet assembly of FIG. 1, prior to attachment to razor handle;

FIG. a section taken on line 5—5 of FIG. 4, further illustrating the shape of the tear-away tab assembly and the swedged neck region of the head by which the packet can be releasably secured relative to the razor handle as well as to automatically open the reservoir to the exterior when the packet is detached;

FIG. 6 is a bottom view of the razor assembly on FIG. 1 illustrating a user's finger position during use of the razor assembly of FIG. 1;

FIG. 7 is an alternate embodiment of the packet assembly of the present invention;

FIG. 8 is a section taken on line 8—8 of FIG. 7;

FIGS. 9 and 10 are details of the tear-away tab assembly of FIGS. 7 and 8;

FIG. 11 is a perspective view of an alternate razor assembly in accordance with the present invention;

FIG. 12 is a side elevation of razor assemblies in accordance with FIG. 11 illustrating how they may be stacked for easy packaging and/or transport.

DETAILED DESCRIPTION OF THE BEST MODE OF THE INVENTION

The following is a detailed description of preferred embodiments of the present invention and is presented by way of example only and is not intended to limit its applicable principles. Furthermore, the description is intended to clearly enable one skilled in the art to make and use the invention. It also includes various adaptations, variations, alternatives and different uses of the invention including what is presently believed to be the best mode of carrying out the invention.

Referring to FIG. 1, a disposable razor assembly 10 is shown that includes a hollow handle 11 connected through a arcuate support housing 12 to a razor head 13. The razor head 13 is of conventional construction and includes two spaced apart metallic blades 14 covered by a shield 15. Normally, the razor head 13 will be formed of injection-molded plastics material and the blades 14 will be embedded in the plastics material during the molding operation as conventional in the art. In this regard, suitable plastics materials include polyethylene, polypropylene, polystyrene and polycarbonates. Thereafter, the handle 11 is subjected to heat so as to receive and secure plastic packet assembly 16 relative to surfaces 17*a*, 17*b* thereof. Since the razor head 13 and the handle are of the type employed conventionally in disposable razors, they form no part of the present invention except in combination with the integrally-formed plastic packet assembly 16 of the present invention.

Figure 3:
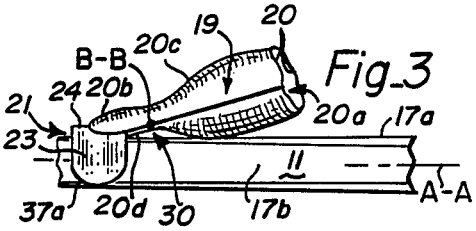
Figure 5:
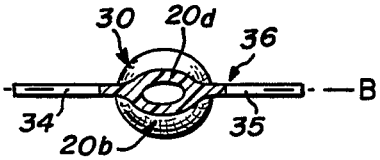

FIGS. 3, 4 and 5 illustrate plastic packet assembly 16 of the present invention in more detail.

Briefly, packet assembly 16, as seen in FIG. 4, includes an integrally-formed tear-away tab assembly 18 releasably attached to a plastic packet 19. The packet 19 includes a continuous side wall 20. The wall 20 forms interior reservoir 20*a* filled with a single-use serving of shaving-associated materials, such as shaving lathers, gels, after shave-lotions and the like. Along an edge of wall 20, protuberance 20*b* is formed adjacent to shoulders 20*c*. Between shoulders 20*c* and protuberance 20*b*, is reduced neck region 20*d*.

Tab assembly 18 includes a base member 21. Base member 21 is foldable along dotted fold lines 22, so as to form a pair of wings 23. The wings 23 flank central region 24. Attachment of tab assembly 18 to the razor handle 11 is an follows: The wings 23 are attached to opposite upright surfaces 17*b* of the handle 11, while central region 24 extends above broad surface 17*b*. Attachment is preferably by thermal welding.

Relative positions of the protuberance 20*b*, base member 21 and handle 11 is seen best in FIG. 3 in which the wings 23 are thermally welded to upright surfaces 17*b* of handle 11. The shape of protuberance 20*b*, however, prevents the central region 24 of base assembly 21 from tightly contacting broad surface 17*a* as shown in FIG. 3.

Further features and details of the packet assembly 16 will become more apparent from a brief description of how the various elements can be formed.

For example, a series of packet assemblies 19 can be serially cut from a long tube (not shown) of either polyethylene, polypropylene or polycarbonate. Such seals and cuts occur after the tube has been filled with a shaving-associated material in the manner analogous to providing sample packets in the food and shampoo industries.

In more detail, first the plastic tube can be fitted over an exhaust nozzle of a loading machine, and the shave-associated material is injected throughout the entire length of the tube. Thereafter, a series of packets can be cut and sealed transverse to the longitudinal axis of symmetry of the tube analogous to formation of sample packets as previously described. In order to provide the protuberance 20*b* at the edge of such plastic tube, the wall of the tube must be softened and then reshaped to the proper form under external forces. Note that as the temperature of the precursor plastic tube is elevated and as opposed transverse seals as well as protuberance 20*b* are formed, breaks in the tube wall must be avoided.

Forming other portions of the assembly such as tear-away neck 20*d* can be similarly achieved. E.g., placing protuberance 20*b* in tension as the transverse seals are formed, provides a suitable technique by which neck region 20*d* is formed.

Formation of each tab assembly 18 occurs simultaneously with the formation of the protuberance 20*b* and reservoir 20*a*. Since each tab assembly 18 is formed from the precursor plastic tube in the manner previously described in integral manner, the technique will not be discussed in detail except to say that the winnowing of the excess plastic material to form the tab assembly 18 is such that base member 21 flanks protuberance 20*b*.

However, certain elements of integrally-formed, tear-away central region 30 (FIG. 3) can be sequentially provided. In this regard, note that tear-away region 30 includes neck 20*d* and transverse cuts 34, 35 (FIG. 5) formed in swedged region 36 of the central region 30. Neck 21*d* and swedged region 36 are formed of excess plastic materials occurring at the transverse edges of the packets as the latter are formed. But usually the neck 20*d* and swedged regions must be worked, say by the application of tensile forces in the manner previously described, to provide the final configuration. After transverse cuts 34, 35 have been sequentially produced to a given depth within the swedged region 30, such cuts 34, 35 are seen to be aligned with neck 20*d* along axis B—B. Such alignment defines a common plane intersecting axis A—A handle at an angle greater than 90 degrees with respect to reservoir 20*a*.

FIG. 5 illustrates the positional relationship of transverse cuts 34, 35 and axis B—B in more detail.

As shown, the axis B—B is coincident with swedged region 36 and bisects neck 20*d* at the narrow span of the latter. In that way, the neck 20*d* as well as the transverse cuts 34, 35 are positioned in clear alignment with each other.

After packet assembly 16 of FIG. 4 is attached piggy-back style to the razor handle 11 at broad surfaces 17*a*, 17*b*, ; the resulting razor assembly 10 can be packaged with another assembly 10' (FIG. 2) and both housed within plastic container 40 e.g. a poly bag. Thereafter, container 40 can be sold to a user in conventional commercial commerce.

FIGS. 1, 3 and 5 also illustrate method aspects of the present invention related to how razor assembly 10 of the present invention can be employed even in a highly humid environment.

Briefly, the packet 19 of FIG. 1 can be simultaneously detached relative to tear-away tab assembly 18 while rupturing reservoir 20*a*, by the steps of:

(a) applying a twisting force to packet 19 in the direction of arrows 38, 39 along a twisting axis coextensive of the axis A—A of handle 11, while the razor assembly 10 is steadily maintained by the user gripping the handle 11, such stability resulting in part from the large gripping area afforded the user even in the presence of high humidity of the surrounding air, (b) almost simultaneously, causing release of the packets 19 from the tab assembly 18 wherein such release is along transverse cuts 34, 35 associated with swedged region 36 and thence across neck 20*d* of protuberance 20*b* to cause rupture of the protuberance 20*b* and place the contents of reservoir 20*a* in open, continuous single-use fluid contact with the exterior of the packet 19.

Now in more detail, note that separation of the packet 19 from the tab assembly 18, can be enhanced by the use of indicia 37, see FIGS. 1 and 6, to indicate desired positions of the user's hand to affect a stabilizing position as the packet 19 is separated. Such separation occurs as a consequence of twisting force applied along arrows 38, 39. Note also that the twisting movement provided the packet 19 by the user is about an axis normal to axis B—B depicted in FIGS. 1, 3 and 4–5.

FIG. 6 illustrates a further capability of the razor assembly of the present invention wherein shaving can occur utilizing shaving head 13 without the packet 19 being detached from the razor handle 11.

As shown, packet 19 is pivotable about axis B—B. Consequently, space below packet 19 becomes clear for placement of the user's hand (not shown) including finger 41*a* and thumb 41*b* of FIG. 6. Hence, the user can manipulate the razor assembly 10 of the present invention to perform shaving even though packet 19 remains attached to the handle 11.

Use of the shaving assembly 10 of the present invention in the foregoing manner also contemplates employing two or more packet assemblies such as generally indicated at 16 and 16' in FIG. 1. Under these circumstances, assume the most forward packet 19 (relative to shaving head 13) contains after-shave lotion, while rearwardly positioned packet 19' contain shaving cream or shaving gel. Thus, after packet 19' has been detached and the shaving gel applied to the user's face, body, or the like, the razor assembly of the present invention can be easily manipulated by the user using the hand position shown in Figure 6. Such use can occur, even though the packet 19 remains attached at the handle 11 and does not present unduly difficult manipulative problems to the user.

ALTERNATE EMBODIMENTS

FIGS. 7–10 illustrate an alternate plastic packet assembly n accordance with the present invention.

In this regard, note that the alternate packet assembly 50 does not have a protuberance 20*b* as shown in FIGS. 3–5 but instead is provided with a rupturable wall region 52 lying along a diagonal plane coincident with line 8—8, FIG. 7, through a corner of packet 51. Note that manufacture of the alternate packet assembly 50 is also less complex from a tooling standpoint since the rupturable wall region 52 as shown in FIG. 8 is merely a portion of the total wall 53 that defines reservoir 54.

However, the tear-away tab assembly 55 of FIG. 7 is more complex and can be provided (i) separately from packet 51 or (ii) integrally where sufficiently excess material at the edge of the precursor plastic as the packets 51 are formed, is available.

In more detail as shown, the tear-away assembly 55 is seen to include a base 56, a swedged tear-away region 57 (FIG. 8) and an upright wall 58. (FIG. 9) A slot 59 (FIGS. 9 and 10) allows a corner of the packet 51 to be attached as by heat sealing to an upper surface of the base 56 whereby rupturable wall region 52 is placed coincident with the upright wall 58. Note that the swedged region 57 of base 56 (FIG. 8) is still adjacent to its intersection with upright wall 58. Thus, when sufficient pressure is applied to wall 58 in the direction of arrows 63 (see FIGS. 7 and 10), the wall 58 is easily severed from the base 56.

Note also that wall 58 is in surface contact with the edge of the packet 51 along the rupturable wall 52. Thus, when the user initiates pressure, say by placing his fingers at indicia 64 on surface 65 of upright wall member 58 of FIG. 9, the packet 51 is easily detached from the razor handle. Simultaneously, the wall region 52 is ruptured without expelling undue amounts of shaving gel and associate materials from the reservoir 54 because severing forces are surface (not point) distributed.

FIGS. 11 and 12 illustrate yet another alternate embodiment of the razor assembly 10 of the present invention.

As shown in FIG. 11, first and second packet assemblies generally indicated at 70, are similar to those depicted in solid and phantom line in FIG. 1, except that packets 71, 72 are not supported on or atop the razor handle 11. Instead, the packets 71, 72 flank the handle 11 at a common side. Flanking attachment of the packets 71, 72 and their associative tab assembly 73, 74, respectively, is by heat sealing of the latter with the razor handle 11.

That is to say, although each tab assembly 73, 74 of FIG. 11 comprises a base member 76, 77 and wings 78, 79, respectively, the latter do not include fold lines. Instead, the base member 76, 77 and the unfolded wings 78, 79, lay in full surface contact with the top broad surface 17*a* of the handle 11. Note that between wings 78, 79 are reduced swedge section 85, 86, respectively. Each region 85, 86 also includes spaced apart transverse cuts 87 similar to those depicted in FIGS. 3–5.

In accordance with operational aspects of the present invention, the procedure for separating packets 71, 72 from their respective tab assembly 73, 74 is as a consequence of twisting force applied in the direction of arrows 74*a*, 74*b* about a twisting axis that transverse to the axis of symmetry A—A of the handle 11 by the steps of:

(a) in applying a twisting force to packet 71 or 72 along the direction of arrows 74*a*, 74*b* wherein the twisting axis is transverse to the axis of symmetry A-A of the handle 11, while the razor assembly 70 is stably maintained even though the latter may be slippery due to high humidity of the surrounding air; and (b) simultaneously causing rupturing with (i) release of the packets 71 or 72 from the tab assembly 73 or 74, respectively, each such release being the transverse cuts 87 associated with swedge region 85 or 86 and (ii) rupture of the protuberance 89 across reduced neck 88 so as to place the contents of reservoir 90 in fluid contact with the exterior of packet 71 or 72.

In more detail, note that the twisting force to release the packet 71, 72 from the handle 11 is about a twisting axis that is opposed to that depicted in FIG. 1. That is to say the twisting axis is transverse to the axis of symmetry A—A of the handle 11.

After the packet assemblies are attached to handle 11 as shown in FIG. 11, resulting groups of razor assemblies can be packaged together as shown in FIG. 12. As shown, a plastic strap 91 is wound round about upright portions 92 of the packet assemblies 70 of the group of razor assemblies. Additional packaging is thus unnecessary.

It should be understood that various modifications within the scope of the invention can be made by one of ordinary skill in the art without departing from the spirit thereof, the invention to be defined by the scope of the appended claims as the prior art will permit and in view of the specification if need be.

What is claimed is:

1. A razor assembly particularly adapted for use in highly humid environments, comprising:

(a) means defining a shaving head, (b) a handle having a first portion carrying said shaving head suitable to permit said head to be used as a manually operated razor, and a second portion elongated as to provide sufficient area to be grasped by the user's hand, said second portion being provided with one or more broad surfaces, (c) a packet assembly adapted to be releasably connected to said one or more broad surfaces of said second portion piggyback style, said packet including a rupturable sealed reservoir containing normally confined, single-use shaving-associated material; said packet assembly being disposed releasably connected to said handle so that release of said packet from said handle substantially simultaneously ruptures said reservoir irrespective of high humidity at the release site.

2. The improvement of claim 1 in which said reservoir of said plastic packet includes a normally-enclosed, but rupturable wall region whereby exterior and interior surfaces of said reservoir can be placed in fluid contact with one another during release of said packet from said handle.

3. The improvement of claim 2 in which said packet is releasably attached to said one or more surfaces of said handle through an integral tear-away tab assembly.

4. The improvement of claim 3 in which said tab assembly comprises of a base member and a swedged tear-away region, said base member being integrally attached to said packet adjacent to tear-away region whereby user-induced pressure releases said packet from said handle and substantially simultaneously ruptures said wall region.

5. The improvement of claim 4 in which said user induced pressure is applied to said tear-away region of said tear-away tab assembly, and then across a neck region of said reservoir so as to limit undue accidental discharge of said shaving-associated material from said packet during release thereof.

6. The improvement of claim 5 in which indicia are provided to indicate correct placement of a user's fingers to generate said user-induced pressure.

7. A disposable razor assembly having means for defining a shaving head wherein the improvement comprises:

(a) a handle having a first portion for attachment to said shaving head suitable to permit said head to be used as a manually operated razor and a second portion provided with one or more surfaces;

(b) an integral packet assembly adapted to be received at said second portion of said handle piggyback style, said assembly including a sealed integral plastic packet including rupturable wall means for containing single-use shaving-associated materials such as shaving gel, shaving cream, shaving lotion, or the like; said packet assembly also including a tear away tab assembly comprising at least a base member attached to said handle of the razor assembly and swedged tear-away region in action-alignment with a small region of said rupturable wall means whereby a twisting movement releases said packet from said tear-away tab assembly and substantially simultaneously ruptures said small region of said wall means, but does not expel undue amounts of shaving-associated material.

8. In a razor assembly having means defining a shaving head, a handle including a first portion carrying said shaving head suitable to permit said head to be used as a manually operated razor, and a second portion being provided with one or more broad surfaces adapted to be disconnectably connected to a packet assembly that includes a releasable plastic packet containing a sealed rupturable reservoir of normally confined, single-use shaving-associated material, a method for causing substantially simultaneous release of said packet from said handle and rupture of said reservoir irrespective of high humidity at the release site, comprising the steps of:

(a) applying twisting pressure to said packet along a twisting axis to release said packet from said handle while the razor assembly is stable irrespective of the presence of high humidity of air surrounding the release site;

(b) almost simultaneously causing rupture of a small wall region of said reservoir, said twisting surface pressure preventing accidental discharge of said shaving-associated material as said packet is released from said handle and said reservoir is ruptured.

9. The method of claim 8 with the small wall region is a reduced neck region between a protuberance and a shoulder region of the packet.

10. The method of claim 8 in which said twisting axis of twisting pressure is about an axis of symmetry of said small wall region coextensive to the axis of symmetry of said handle.

11. The method of claim 8 in which said twisting axis of twisting pressure is about an axis of symmetry of said small wall region transverse to the axis of symmetry of the handle.

* * * * *